United States Patent [19]

Burchert

[11] Patent Number: 4,993,495

[45] Date of Patent: Feb. 19, 1991

[54] APPARATUS FOR APPLYING FIREFIGHTING CHEMICALS

[75] Inventor: Peter P. Burchert, Kamloops, Canada

[73] Assignee: Chemonics Industries, Inc., Phoenix, Ariz.

[21] Appl. No.: 395,601

[22] Filed: Aug. 18, 1989

[30] Foreign Application Priority Data

Aug. 25, 1988 [CA] Canada ..... 575734

[51] Int. Cl.[5] ..... A62C 5/02

[52] U.S. Cl. ..... 169/14; 169/15

[58] Field of Search ..... 169/14, 15, 13, 44; 137/888; 138/44

[56] References Cited

U.S. PATENT DOCUMENTS

| | | | |
|---|---|---|---|
| Re. 25,037 | 9/1961 | Brazier | 169/14 X |
| 623,851 | 4/1899 | Van Riper et al. | 169/15 |
| 2,183,561 | 12/1939 | Hamblin | 169/15 X |
| 2,356,286 | 8/1944 | Timpson | 169/14 X |
| 2,630,183 | 3/1953 | Foutz | 169/15 |
| 4,416,610 | 11/1983 | Gallagher, Jr. | 137/888 X |

FOREIGN PATENT DOCUMENTS

| | | | |
|---|---|---|---|
| 668220 | 8/1963 | Canada | 169/14 |
| 1015694 | 9/1957 | Fed. Rep. of Germany | 169/15 |
| 1428452 | 1/1969 | Fed. Rep. of Germany | 137/888 |
| 1101106 | 9/1955 | France | 137/888 |
| 1154485 | 5/1985 | U.S.S.R. | 169/15 |
| 764114 | 12/1956 | United Kingdom | 169/15 |

*Primary Examiner*—Margaret A. Focarino
*Assistant Examiner*—James M. Kannofsky
*Attorney, Agent, or Firm*—William H. Drummond

[57] ABSTRACT

Improved apparatus for fighting wild fires includes an inductor for foam forming chemicals positioned in the discharge conduit of a water pump. The inductor includes a hollow barrel having a short pipe orifice therein and a foam concentrate liquid induction port to supply the liquid at the vena contracta of the pumped water flowing into the inductor.

1 Claim, 1 Drawing Sheet

APPARATUS FOR APPLYING FIREFIGHTING CHEMICALS

Figure 1:
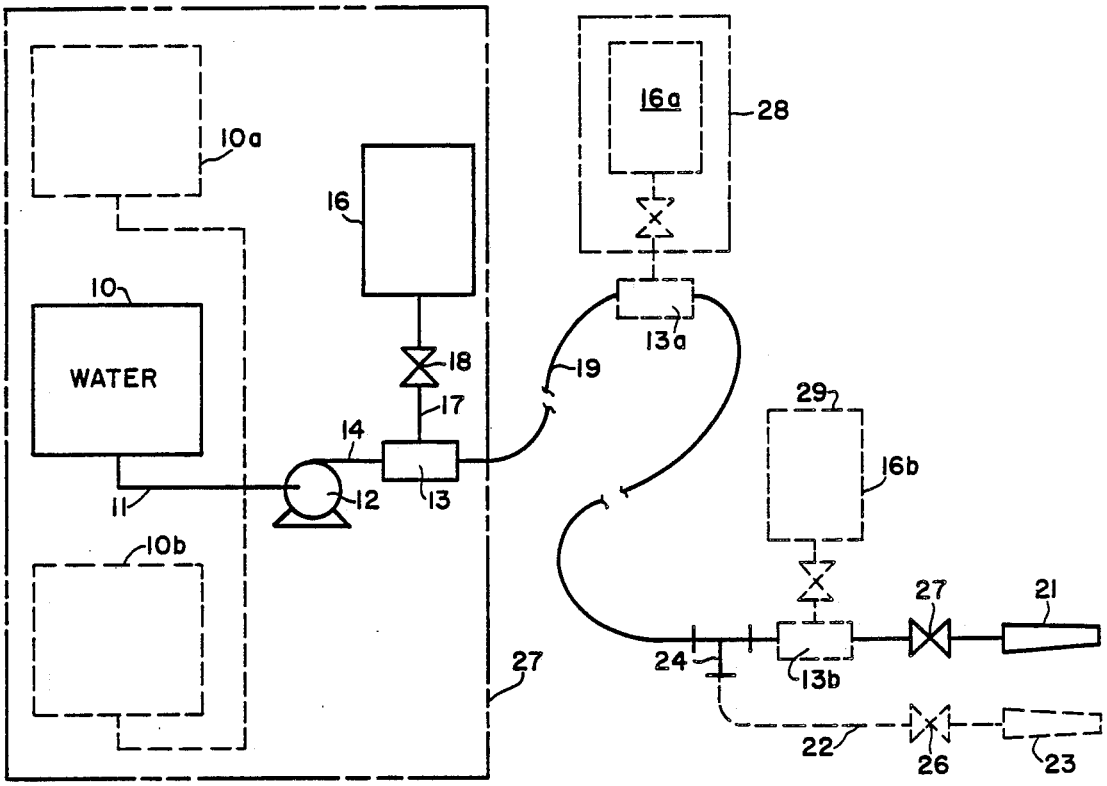

This invention relates to apparatus for fighting wild fires.

More particularly, the invention concerns improved apparatus for producing fire-fighting foam.

In another and more particular respect, the invention relates to foam production apparatus for fighting wild fires which is of simplified construction and which requires little or no maintenance or adjustment.

In still another aspect, the invention concerns fire-fighting apparatus adapted to direct either a stream of water or a stream of foam or both at burning vegetation.

The use of various foam materials for fighting fires is well-known. More recently such foams have been used in fighting wild fires, e.g., forest fires, brush fires range fires, etc. . In such applications the foams are typically applied by individuals carrying and manipulating lengthy hoses which are in turn connected to foam producing apparatus located on ground vehicles.

A typical foam delivery vehicle is a truck carrying a large water tank, a pump for delivering water from the tank under pressure to a hose. A smaller supply tank of liquid foam concentrate is carried on the truck and a means of mixing the foam and air with the water is provided.

In the prior art, the typical foam producing system includes liquid chemical eduction system located on the suction side of the pump. Alternatively, a separate injection system, employing a second pump is employed to discharge the requisite amount of foam producing liquid concentrate into the water downstream of the water pump.

These prior art foam chemical mixing systems have the advantage of performing the mixing operation without reducing the volume or pressure of the main water pump. Another system which has been employed uses a venturi mixing system in the water pump discharge line. Such Venturi mixers are lengthy, which causes substantial bending forces to be applied to fittings which connect the Venturi mixer to other parts of the apparatus, e.g., the pump discharge or pump discharge piping. Also, this system severely restricts and reduces the amount of water and/or the pressure of the water delivered from the water supply pump. All of these prior art systems are somewhat complicated and require substantial maintenance and adjustment to ensure proper operation. Such complications and such maintenance and adjustment operations detract seriously from the utility of such systems in fighting wild fires because the persons operating such equipment are usually of limited skill and such operations must be carried out under very primitive field conditions.

It would be highly desirable to provide an improved foam chemical-water mixing system which is especially adapted for use in combatting wild fires under primitive field conditions.

Accordingly, the principal object of the present invention is to provide an improved simplified system for fighting wild fires with foams.

Yet another object of the invention is to provide such an improved system which is of simplified construction.

Still another object of the invention is to provide a system for fighting wild fires with foams which is easier to maintain and which requires little or no adjustment for proper operation.

Another object of the invention is to provide an inductor/mixer which is relatively shorter than a Venturi inductor or mixer, so as to reduce the stress force placed on other parts of the system to which it is connected.

Figure 2:
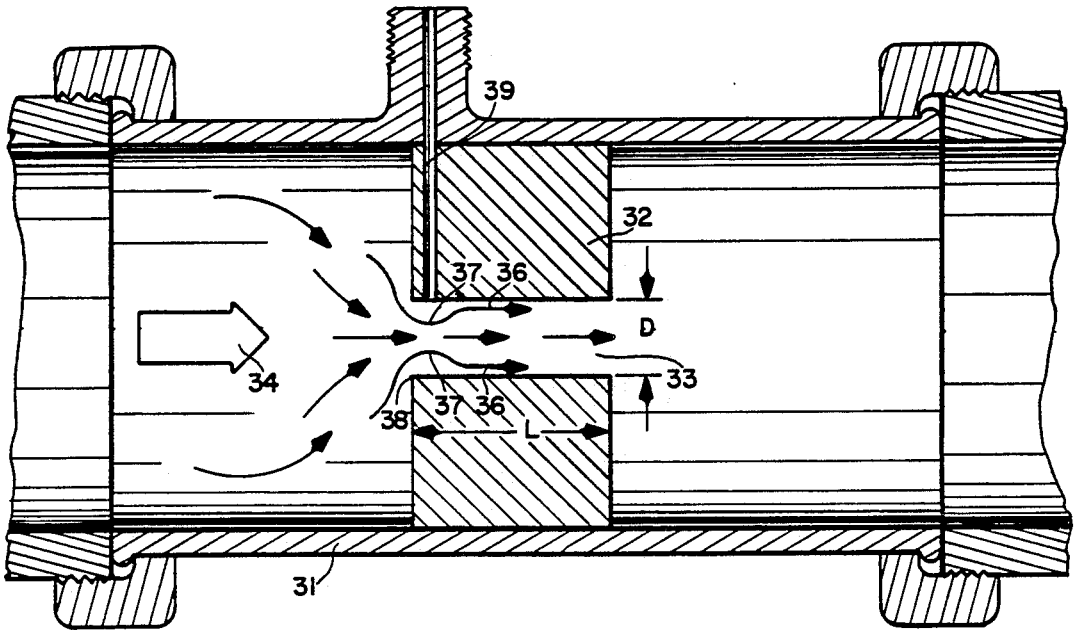

These, other and further objects and advantages of the invention will be apparent to those skilled in the art from the following detailed description thereof taken in conjunction with the drawings, in which:

FIG. 1 is a flow sheet which schematically illustrates a system for fighting wild fires in accordance with the principal of the present invention; and FIG. 2 is a sectional view of foam chemical liquid inductor, constructed in accordance with the principal of the present invention, which is used in the system of FIG. 1.

Briefly, in accordance with the invention, I provide improved apparatus for fighting wild fires of the general type which includes a water supply tank, a pump for delivering water under pressure from the water supply tank a liquid concentrate supply tank, means for mixing the concentrate with the water, nozzle means for applying the mixture (foam) to the vegetation, and conduit means connecting these elements for operation.

My improved system comprises in combination with these elements, an inductor/mixer in the conduit downstream of the pump. The inductor/mixer includes hollow barrel portion, a short pipe orifice member positioned in the barrel, the length of the orifice apparatus being at least 2.5 times the diameter of the aperture, and means defining a concentrate liquid port in the barrel for inducting the liquid at the vena contracta of pumped water flowing therethrough.

Turning now to the drawings, which are provided for the purpose of illustrating the practice of the invention and which do not constitute limitations on the scope thereof, FIG. 1 illustrates a typical improved system for combatting wild fires utilizing the principals of the present invention. Water is supplied from tank 10 through pump suction pipe 11 to the inlet of a centrifugal pump 12. An inductor/mixer 13 (see FIG. 2) is connected in the discharge conduit 14 from the pump 12. Foam liquid concentrate is delivered from a concentrate supply tank 16 through conduit 17 provided with a shut off/ control valve 18. The mixed concentrate liquid and water is discharged from the inductor/mixer 13 through conduit 19 to a foam producing nozzle 21. As will be observed, the water tank 10 can be located either higher than the pump suction, as indicated by the dashed lines 10*a*, or lower than the pump suction as indicated by the dashed lines 10*b*. Likewise, the foam liquid supply tank 16 and inductor 13 can be placed at remote locations from the pump, either part of the way to the end of the conduit 19, as indicated by the dashed lines 13*a* and 16*a*, or immediately next to the foam producing nozzle 21, as indicated by the dashed lines 13*b* and 16*b*.

Indeed, when the concentrate liquid supply tank 16*b* and inductor 13*b* are located proximate the mixing nozzle 21 a separate conduit 22 and nozzle 23 can be provided connected through a tee 24 in the conduit 19 and provided with a separate valve 26. This permits the applicator to select either a stream of foam (from the nozzle 21) or a stream of pressurized water (from the nozzle 23) or both, by manipulating the valves 26 and 27.

In typical installations, the water supply tank 10 concentrate supply tank 16, pump 12 and inductor 13 are all carried by the application vehicle, as indicated by the dashed lines 27. Alternatively, as indicated by the dashed lines 28, the foam liquid concentrate tank could be carried on a separate vehicle or, as indicated by the dashed lines 29, could be hand carried by the applicator.

As shown in FIG. 2, the inductor comprises a hollow barrel portion 31 provided with short pipe orifice member 32, the central aperture 33 of which has a length L which is at least 2.5 times the diameter D of the central aperture 33.

According to well-understood fluid flow dynamics principles, water 34 flowing through the barrel 31 is deflected as indicated by the arrows 36 in such manner as to form an area of lower pressure known as the "vena contracta" 37 which is located downstream of the sharp edge 38 at a distance of one-half D. An induction port 39 is provided which allows for induction of the concentrate liquid into the moving water stream 36 at the vena contracta 37.

In operation the system of the present invention is very easy to construct, maintain and operate by persons of limited mechanical skill. The inductor can be installed anywhere in the discharge lines from the main water pump and gives excellent foam control by manipulating the valve 18 in the foam chemical supply line 17 to the inductor 13.

The apparatus has an absolute minimum number of parts, only one of which (the pump) is a moving part and the system is therefore very easy to maintain and operate.

Having described my invention in such terms as to enable those skilled in the art to which it pertains to understand and practice it, and having described the presently preferred embodiments thereof, I claim:

1. In apparatus for fighting wild fires, including a water supply tank, a pump for delivering water under pressure from said water supply tank, a fire-fighting liquid concentrate supply tank, means for mixing said concentrate with said water, nozzle means for applying said mixture to vegetation, and conduit means connecting said water supply tank, said concentrate supply tank, said pump and said nozzle, the improved system comprising inductor/mixing means in said conduit downstream of said pump, including:

(a) a hollow barrel portion;

(b) a short pipe orifice positioned in said barrel, said short pipe orifice having a length and a constant inner diameter, the length thereof being at least 2.5 times the inner diameter thereof; and (c) means defining a concentrate liquid port in said barrel for inducting said liquid at the vena contracta of pumped water flowing therethrough.

* * * * *